US005206641A

United States Patent [19]

Grant et al.

[11] Patent Number: 5,206,641

[45] Date of Patent: Apr. 27, 1993

[54] PORTABLE TRAFFIC CONGESTION RADIO

[75] Inventors: Charles A. Grant, Kensington; Mark L. Greenberg, Berkeley, both of Calif.

[73] Assignee: Way To Go Corporation, Berkeley, Calif.

[21] Appl. No.: 815,433

[22] Filed: Dec. 31, 1991

Related U.S. Application Data

[63] Continuation-in-part of Ser. No. 609,208, Nov. 5, 1990, abandoned.

[51] Int. Cl.[5] ..... G08G 1/09

[52] U.S. Cl. ..... 340/905; 340/988; 455/186.1

[58] Field of Search ..... 340/905, 907, 870.12, 340/936, 937, 988, 990, 995; 364/438, 437, 436, 444, 449; 455/186, 228

[56] References Cited

U.S. PATENT DOCUMENTS

| | | | |
|---|---|---|---|
| 4,301,506 | 11/1981 | Turco | 340/988 |
| 4,357,593 | 11/1982 | von Tomkewitsch | 340/988 |
| 4,409,583 | 10/1983 | Dahan et al. | 340/995 |
| 4,792,803 | 12/1988 | Madnick et al. | 340/905 |
| 4,819,174 | 4/1989 | Furuno et al. | 340/988 |
| 4,888,699 | 12/1989 | Knoll et al. | 340/995 |
| 4,990,900 | 2/1991 | Kikuchi | 340/712 |
| 5,020,143 | 5/1991 | Duckeck et al. | 340/905 |
| 5,095,532 | 3/1992 | Mardus | 455/186 |

FOREIGN PATENT DOCUMENTS

| | | | |
|---|---|---|---|
| 0345818 | 12/1989 | European Pat. Off. | 340/905 |
| 0349470 | 1/1990 | European Pat. Off. | 340/905 |

*Primary Examiner*—Jin F. Ng
*Assistant Examiner*—Brent A. Swarthout
*Attorney, Agent, or Firm*—David B. Harrison

[57] ABSTRACT

A portable electronic device receives and stores digitally coded traffic reports for a covered geographical area. Upon user request, the device presents traffic information relevant to a user-specified vehicle trip within the covered area. Traffic reports are collected at a traffic operations center and are encoded and then broadcast to the units within the covered geographical area using radio frequency transmission. A touch-sensitive map is used to indicate trip origin, destination, and routings of interest. The device makes calculations to select and modify the relevant reports; and the traffic information from the selected reports is presented to the user by synthesized or digitized voice sounds. In addition to presenting the information on demand, the device also automatically announces new traffic reports received by the device which are relevant to the user-specified trip.

10 Claims, 4 Drawing Sheets

PORTABLE TRAFFIC CONGESTION RADIO

This is a continuation-in-part of U.S. patent application Ser. No. 07/609,208, filed on Nov. 5, 1990, now abandoned.

FIELD OF THE INVENTION

This invention relates to methods and apparatus for mobile radio reception of, analysis of, and presentation of digitally communicated information specifically related to traffic congestion information for drivers.

BACKGROUND OF THE INVENTION

Heretofore, drivers have received traffic congestion information announced over radio and television stations. Information communicated in such fashion has several disadvantages: it is generally delayed from the time of observation of the traffic conditions; it is announced from time-to-time and not necessarily at the time needed by a driver; and, it is generally addressed to a broader audience than individual drivers and their intended courses of travel. Also, traffic congestion information has been communicated over telephones (including mobile and cellular telephones). The primary disadvantage here is that the availability of information is limited to times when the driver can use a telephone. Also, traffic congestion information services have communicated information using radio pagers with alphanumeric display capability. The primary disadvantages of this approach is that the amount of information capable of being viewed is limited, and viewing visual information in a moving vehicle can be a safety hazard.

Experimental projects in Los Angeles, Calif., and Orlando, Fla., have provided traffic congestion information to receiving units mounted in vehicles. These units include a visual screen showing the position of the vehicle on a map. Information is presented both visually and via synthesized speech. The primary disadvantage of this approach is that information about congestion is frequently of interest outside the car, for example, in deciding whether to take a trip, or when to depart. Furthermore, these systems are hardware intensive and therefore are relatively expensive.

U.S. Pat. No. 4,480,253 (entitled: "Wrist Watch Weather Radio") describes the distribution of weather information to portable units over radio frequencies. However, this patent does not cover the distribution of traffic congestion information or methods for selecting specific locations of interest.

U.S. Pat. No. 4,812,843 (entitled: "Telephone Accessible Information System") describes the communication of route-specific traffic congestion information. The disadvantage of this approach is that route selections require telephone access to a central computer data base and thus cannot be conveniently used for instant response regarding trips not pre-selected by telephone.

SUMMARY OF THE INVENTION WITH OBJECTS

Several objects and advantages of our invention are that traffic congestion information can be made available for drivers so that:

1) the information is significantly more current than any prior form of delivery of traffic information;
2) the information is available virtually instantaneously upon request by a driver, without (for example) the requirement to wait for a radio or TV station to announce the information;
3) the information is available anywhere a driver happens to be, including at home, at the office, outdoors, or walking to the vehicle, for example;
4) the invention selects among all the traffic reports for those related to the trip of interest to the driver, so that the driver need not be delayed or distracted by irrelevant traffic information;
5) when relevant traffic congestion conditions change, the driver can be spontaneously informed;
6) the portable device of our invention need not include two-way communication, visual display or vehicle positioning capability that would otherwise increase the complexity and cost of the device;
7) the portable device of our invention may be held and operated in one hand and without being viewed by the driver, thereby enabling the driver to remain focused upon immediate driving conditions;
8) the information given by the device of our invention may include predictions for delay until congestion clears, so that the driver can have estimates of delay that would actually occur upon arrival at the area of congestion; and,
9) The information provided by our invention includes the best or fastest route recommendations for specified trips, based on current and projected traffic congestion delays.

In accordance with the principles of our invention, a method is provided for presenting traffic condition information to a user by use of a portable, battery operated receiving and data processing device. The method comprises the steps of:

receiving digitally encoded information broadcast by radio transmitter;

decoding the received digitally encoded information;

identifying which of the information was traffic information specifically broadcast for reception by the unit, such information normally to include encoded specific roadway location, affected roadway direction of travel, nature of traffic problem, and current and expected delays of any related traffic congestion;

storing the identified information within a data base contained in a digital memory of the device by standard data processing circuitry;

maintaining the data base with the processing circuitry in order to remove reports from the data base no longer considered current;

receiving and storing with the aid of a user data input keyboard of the device user supplied travel description data including origin, routing and destination information;

searching the traffic report data base in function of the travel description data, thereby to select traffic reports determined to be relevant to the travel description data, and presenting via a user presentation element of the device the selected relevant traffic reports.

In one aspect of the present invention, the steps of searching for and presenting relevant traffic report information are carried out in response to a further step of responding to a user request for presentation of traffic information.

In another aspect of the present invention, the step of presenting relevant traffic report information is carried out upon receiving new or updated recognized traffic report information determined by the searching step to be relevant to the user supplied travel description data.

In another aspect of the present invention, the step of presenting relevant traffic information comprises the step of converting the relevant travel information into analog sound signals and translating the analog sound signals into audible sounds with a loudspeaking element of the receiving device.

Further objects, advantages, aspects and features of our invention will become even more apparent from a consideration of the drawings and the ensuing description of a preferred embodiment.

DETAILED DESCRIPTION OF A PREFERRED EMBODIMENT

Figure 1:
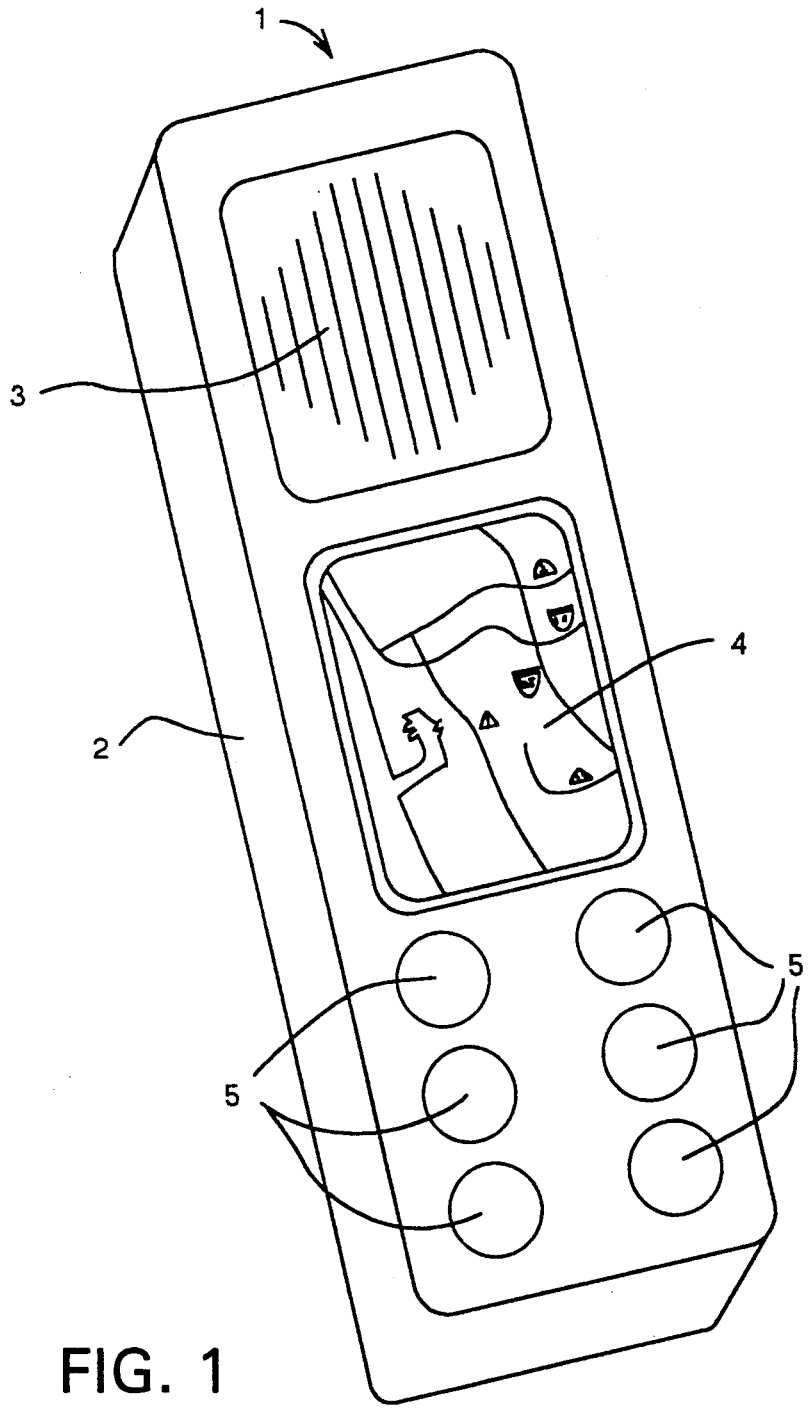
FIG. 1 is a somewhat diagrammatic perspective view of a portable electronic traffic congestion receiver in accordance with principles and aspects of the present invention.

Referring to FIG. 1 of the drawings, a preferred traffic congestion receiver 1 includes a housing 2, loudspeaker vents 3, a map 4, and buttons 5. The housing 2 encloses the internal components and allows the device 1 to be held in the hand or mounted in convenient locations for use. In particular, the housing 1 allows for one-handed, eyes-off operation while driving a motor vehicle.

The speaker vents 3 allow sound emanated from an internal loudspeaker to be audible to the driver. In particular, the speaker vents 3 are so oriented on the device 1 as to be easily held close to the ear for operation in noisy environments, such as a truck cab.

The map 4 allows a location or sequence of locations to be indicated by pressing on the map 4 with a finger. The map 4 may be constructed any number of ways that allow the selection of a region on the map 4 by pressing on it with a finger or stylus. For example, the map 4 may be constructed of a standard x-y matrix keyboard with a flexible printed overlay showing the map plan for the particular area of interest. Alternatively, the map plan can be printed on a rigid material with holes that allow buttons to protrude for selecting the area around the button. Alternatively, the map plan can be printed in sections on the caps of buttons which are closely spaced so as to comprise the complete road map plan. Thin membrane switch technology can also be used for the map 4.

The buttons 5 allow input of a specific request to the device 1 in conjunction with having entered origin, routing and destination data using the map 4. Not shown in the FIG. 1 depiction are other structural features present in the device 1, such as an access panel enabling access for battery removal and replacement, a volume control, and a jack for data communication of information for purposes such as manufacturing test, printer output, or other direct input of data and information into the device 1.

Typical use of the device 1 is to press two locations on the map 4 to select roadways connecting those locations, followed by pressing one or more buttons to evoke a synthetic or digitized voice output such as:

"Highway 80 West in Berkeley at University Avenue,

Severe congestion due to a jack-knifed truck. Delays up to 20 minutes until 4:30 PM."

Figure 2:
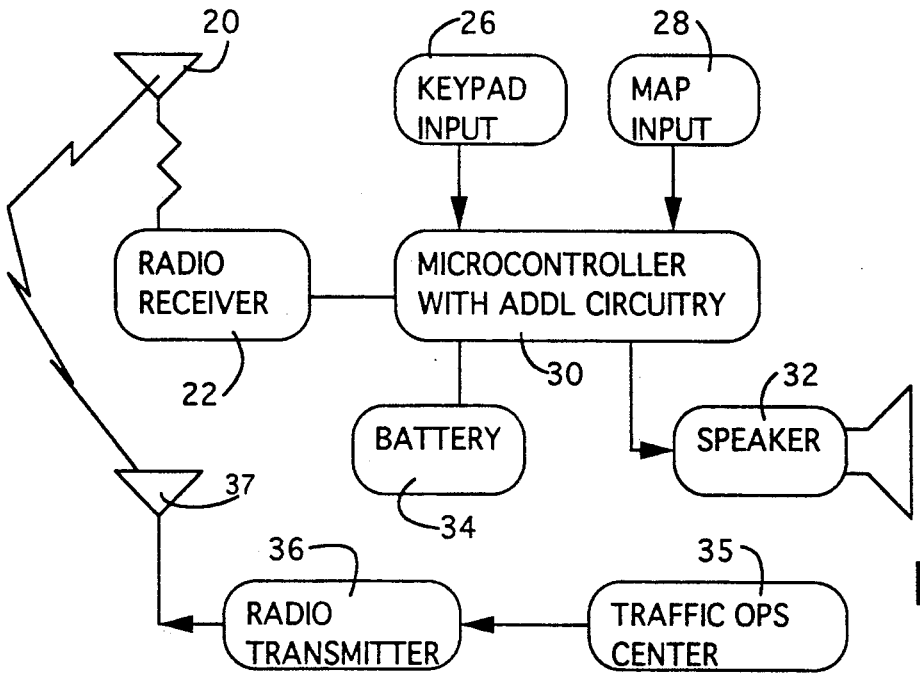
FIG. 2 is a block diagram of the internal components of the FIG. 1 device.

Referring to FIG. 2 of the drawings, a block diagram of the internal components of the device 1 is shown. An antenna 20 and radio receiving circuit 22 are of a nature as commonly used in prior art radio pagers. The microcontroller system 30 includes RAM, ROM and additional circuitry as commonly used in prior art such as hand-held computers. A loudspeaker 32 is mounted so as to direct sound through the speaker vents 3. Batteries 34 provide power for operating the device 1.

Figure 3:
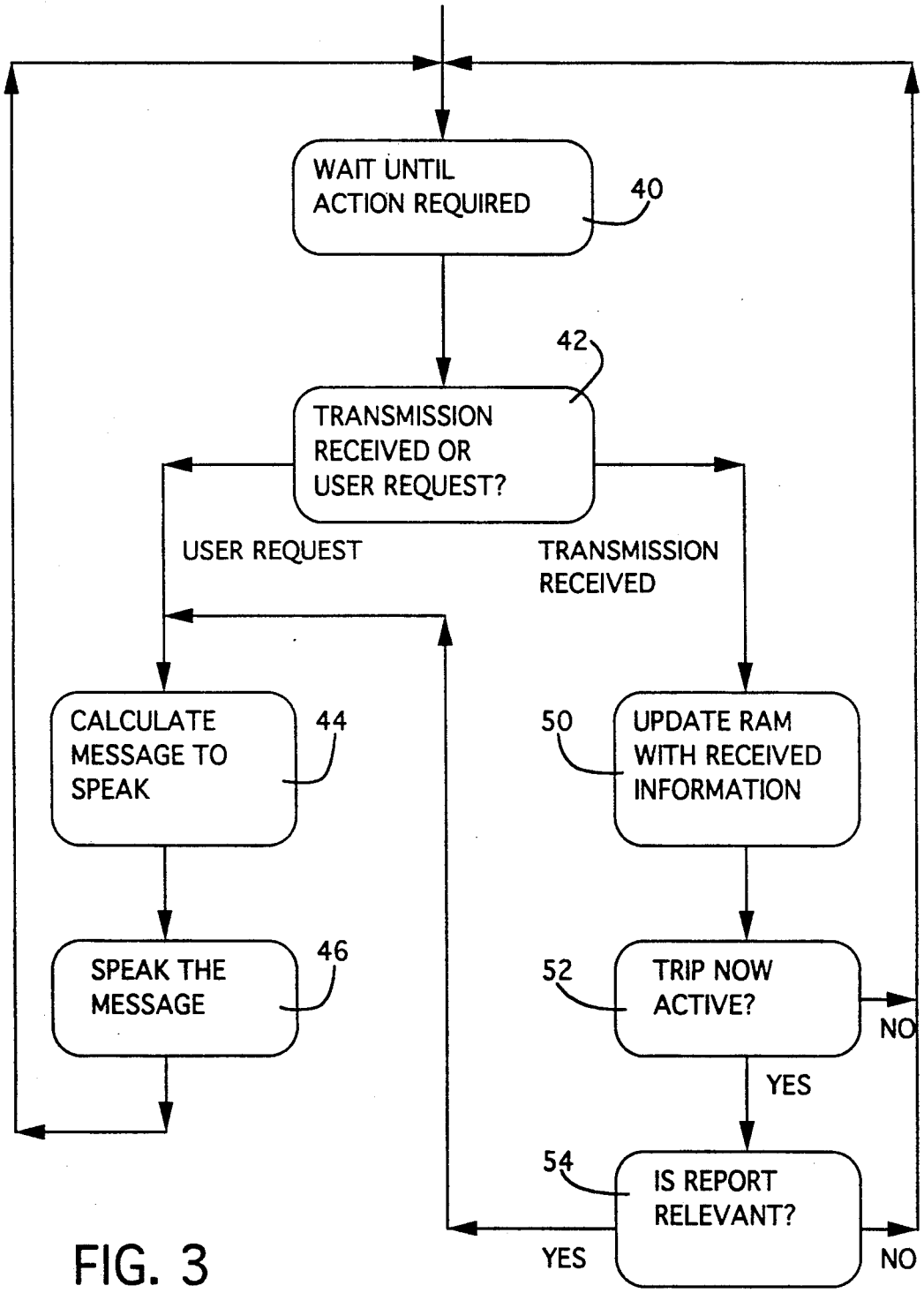
FIG. 3 is a flow chart showing the functional steps performed by the FIG. 1 device.

Referring to FIG. 3 of the drawings, the structure of the program operating the microcontroller system 30 is indicated. Initially, at step 40, the program decides whether any action is required. If so, step 42 decides whether the action to be performed is to receive new traffic information, or rather to respond to user input data commands. In the case of receiving new or updated traffic information step 50 will store the information in RAM memory; step 52 will check if the user has requested to be alerted about changed conditions pertaining to a trip as specified by user input data; if so, step 54 will decide whether the new information should be announced spontaneously (and then transfer to step 44 described below) or return to step 40 and check for further actions required.

In the case of a user request, step 44 will cause the microcontroller 30 to scan the data base in the RAM memory to determine the response(s) with locations and directions of travel relevant to the specified trip, adjust the delay prediction according to the actual time of day of the request, determine the wording to be synthesized and generated at the loudspeaker, and convert that wording via a digital to analog converter within the additional circuitry of the microcontroller 30 into analog signals to cause the speaker to output the message.

It will be appreciated then, that the device may be used by individuals to indicate trips and be informed, by a synthesized or digitized voice sound, about congestion conditions that might apply to their trip. The device performs its operation by receiving messages concerning all reported congestions in a covered area, and by storing all of the messages as a data base in its RAM memory. The device 1 is thus able to respond to information relevant to a particular trip because it has information relevant to all possible trips in the covered geographical area.

Furthermore, it will be appreciated that the device 1 can adjust its spoken voice response depending on the actual time of a user request. For example, if a traffic report has been sent saying that congestion delays at a specific location are predicted to be ten minutes at 3:30 PM, 20 minutes at 4:00 PM, and 15 minutes at 4:30 PM, then the device program can present one or more delay times tailored to the actual time of the user request and to the distance of the congestion location from the origin of the user's indicated trip plan.

Figure 4:
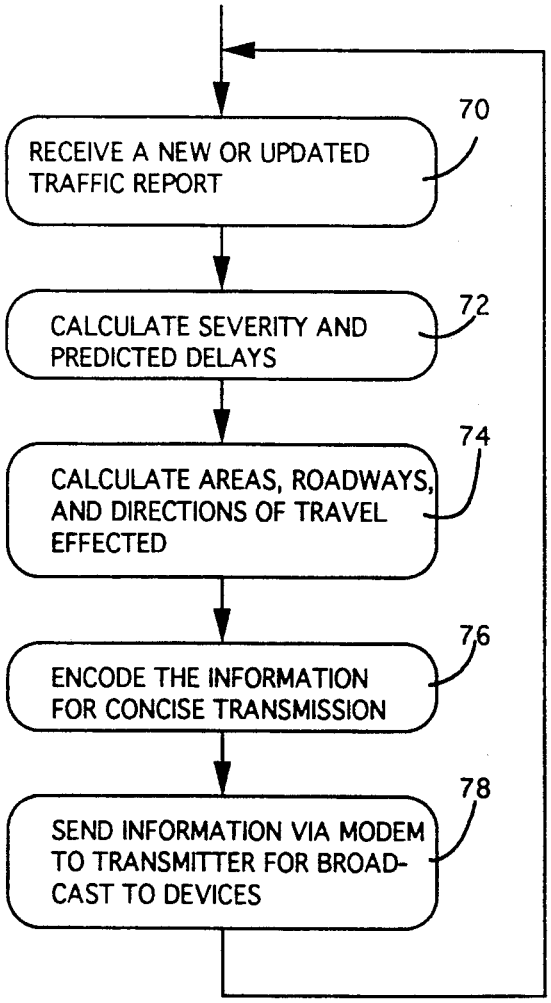
FIG. 4 is a flow chart of a computer program that operates at a traffic operations center sending digitally coded traffic reports to the FIG. 1 device by radio transmitter.

Referring now to FIG. 4, a flow chart is shown indicating an operational sequence for a program on a computer system operated on the site of a government or private Traffic Operations Center. At a step 70, an operator inputs the description of a traffic incident or other traffic report to the program. Such input preferably includes the roadway identification, position along the roadway, direction of travel, description and severity of the incident, speed of vehicles in the backup, flow rate of vehicles past the bottleneck of the congestion, and time of the reported observation. Step 72 then interprets the information in conjunction with any known traffic patterns pertaining to the location of the incident, and calculates travel delays to be expected at future times until the predicted time of return to normal flow. Such calculation methods are known in the prior art. Step 76 then encodes the information into a concise representation and sends the encoded information e.g. over a modem to a radio transmitter to be broadcast via radio frequency carrier to all of the devices 1 in the area covered by the Traffic Operations Center and radio transmitter range.

It will be appreciated that a Traffic Operations Center (either publicly or privately operated) receives traffic congestion information resulting from human observations and also from roadway instrumentation, when installed and operating. All such reports (including updates and corrections) are input to a computer both directly and by way of an on-site human operator. The information is analyzed by a program for estimates of delays and/or duration of congestion. Likewise, all such reports are encoded for conciseness and sent by modem or other means to a transmitter for broadcast to the devices 1 over paging frequencies, mobile radio frequencies, cellular phone frequencies, or FM subcarrier frequencies. The sent data may be compressed in accordance with known data compression techniques.

Users preferably select which roadways and directions of travel along those roadways that are of interest. In the preferred embodiment, a user preferably selects all of the roadways (in all directions of travel) in a particular region by pressing that region on the map. Roadways usable for a trip from a starting location in one region to a destination location in another region are selected by first pressing the region of the starting location and then pressing the region of the destination location. In order to receive information about a trip which follows a specific routing through multiple regions (in order to restrict the roadways reported by the user's device 1 to those that follow the user's specified routing), the user presses three or more regions in sequence (or draws a finger along the desired routing) where the intermediate regions indicate the more specific routing of interest to the user.

Although the map-pressing method for entering trip description data into the device 1 is part of the invention, the invention covers other methods of trip or region selection data entry when applied to a portable device, such as inputting highway numbers, road names or numbers with a keypad; selecting roadways by scanning a list of roadways using voice input or an alphanumeric display; using two dials to select starting region and a destination region on a map by indicating horizontal and vertical coordinates; identifying regions by a coding system described on the device either in map form or in the form of a list of region names and coding.

After identifying a region or trip, it is intended that the user have convenient methods for specifying ways in which the congestion information will be presented. The preferred embodiment of the device allows the user to select between a continuous report of the relevant congestion information or, alternatively, to receive only one report at a time, as paced by repeated button presses. The device 1 also allows the user to select between presentation of the information in summary form or in detail form. For example, a summary traffic congestion description might be: "Severe congestion" and a detailed description might be: "Traffic is backed up for 7 miles due to a chemical spill and is moving at 3 to 5 miles per hour, with delays up to 35 minutes predicted until 4:30 PM."

EXAMPLE

Figure 5:
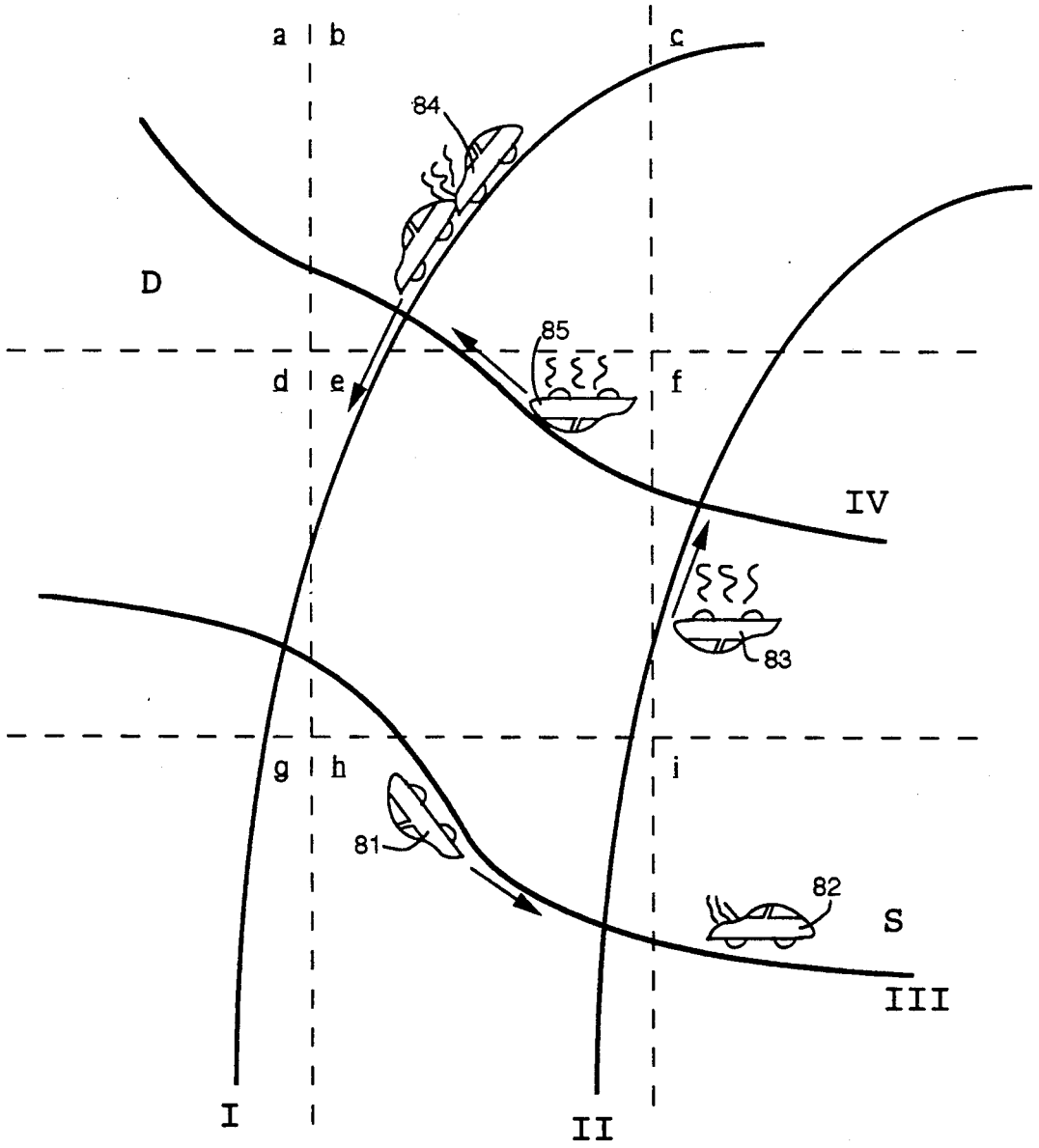
FIG. 5 is a map plan illustrative of aspects of the present invention.

FIG. 5 represents an abbreviated urban highway network within a predetermined geographical area. Lines I, II, III, and IV represent highways. Figurative vehicle incidents adjacent to the highways represent currently active points of congestion that have been reported to a Traffic Operations Center. The arrows associated with each congestion point indicate the direction of travel of the congestion. S and D represent respectively the source and destination location of a desired trip.

Each of the reported congestions has been broadcast to all of the devices 1 of the present invention which are active in the geographical area. A coded description of each of the reported congestions is stored in the memory of each device 1. If a user inputs a trip description from S to D, the device chooses congestions 82 and 83 for presentation and does not choose congestions 81 or 84. Furthermore, if, at a subsequent time, a new congestion 85 is reported along highway IV between highway I and highway II in the direction from S to D, the information would be broadcast to all devices. The example device 1 with the S to D trip selection would spontaneously present the information immediately upon receiving the report relating to the new congestion 85.

By way of further explanation, the FIG. 5 urban highway map may be divided into a three by three grid, thereby defining nine discrete sectors a, b, c, d, e, f, g, h and i. The data stored in the device 1 about each of the transmitted incidents 81–85 contains the information set forth in the table below, as gleaned from a pre-compiled data base identifying common usage of each specific highway segment for trips in the area. Such gleaning can be compiled manually by individuals familiar with road usage in the area. The presently preferred embodiment has the data base compiled at the traffic operations center, but that is not critical to the present invention. Needless to say, the pertinent trip information is compressed significantly prior to broadcast transmission to all of the devices 1 served in the particular geographical area (the area of FIG. 5, for example).

TABLE

| Incident No. | Relevant Trips |
|---|---|
| 81(h) | a > h, a > i, b > h, b > i, d > h, D > i, e > h; |
| 82(i) | i > h, i > g, i > d, i > a, i > b, i > c, i > e i > f; |
| 83(f) | i > a, i > b, i > c, i > e, i > f, i > c, h > e, h > f, h > c; |
| 84(b) | c > a, c > b, c > d, c > e, c > g, c > h, b > a, b > d, b > e, b > g, b > f, b > h, b > i; |
| 85(e) | f > e, f > a, f > b, f > d, e > a, e > b, e > d, e > g, i > e, i > a, i > b, h > a, h > b. |

Thus, in this example the process of identifying whether the present a specific incident for a selected trip is simply to compare the trip starting region and ending region with coded incident reports stored in the memory of the user's device 1 which coding includes all of the pairs pertinent to the selected trip. In the S>D (i>a) example, coded incidents 82, 83 and 85 are deemed relevant and are reported to the user. This example reflects the trip-input embodiment using map-pressing techniques. The reader will readily understand that different trip input embodiments can be handled in equivalent fashion. Also, should the user desired incident information within a local sector, simply pressing that sector of the FIG. 5 map without any subsequent input within a predetermined time period will cause the microcontroller 30 to extract all incident reports coded as being within the selected sector. Thus, if sector i is selected, incident 82 will be reported to the user. Furthermore, based upon the trip information provided by the user, the device 1 can readily calculate and suggest alternative routings to avoid the incidents, based upon prestored possible trip routings within the urban geographical area being serviced. For example, in the S>D trip, after reporting incidents 82, 83 and 85 to the user, the device 1 can suggest that the trip "be by highway III west, to highway I north, to highway IV west", thereby avoiding incidents 83 and 85.

Thus, as a result of using the invented device 1, a user can instantly be informed of reported congestions pertaining to routes relevant to a selected trip. Furthermore, information not of interest is not presented. Finally, subsequently reported congestions pertaining to the trip will be spontaneously announced.

To those skilled in the art to which the present invention pertains, many widely differing embodiments will be suggested by the foregoing without departing from the spirit and scope of the present invention. The descriptions and disclosures herein are intended solely for purposes of illustration and should not be construed as limiting the scope of the present invention which is more particularly pointed out by the following claims.

What is being claimed is:

1. A self-contained, portable device adapted to be held and operated in one hand of the user for presenting information on the state of traffic conditions in a predefined geographical area, comprising:

a) radio receiver means for deriving digitally coded radio signals from a transmitting source within the geographical area;

b) derivation means connected to the ratio receiver means for deriving a stream of data signals from the coded radio signals;

c) recognition means connected to receive the stream of data signals to recognize those data signals which constitute encoded traffic reports which are to be received by the device;

d) storage means connected to the recognition means for storing a plurality of encoded traffic reports in a memory of sufficient size to hold a predetermined number of currently active traffic reports for the geographical area;

e) user travel selection means operable by a finger of the user's said one hand for entering a selection of roadways and directions of travel into the storage means for which presentation of traffic reports are desired;

f) entering means operable by said finger for entering user defined selected criteria requesting presentation of selected traffic reports based upon selected roadway and direction;

g) search means for searching the traffic reports stored in the storage means and selecting means for selecting the stored traffic reports which are coded to be relevant to the selected roadways and directions of travel in accordance with the user defined selection criteria;

h) conversion means for converting a stored encoded traffic report into a presentation report; and, i) presentation means for presenting the presentation report to the user.

2. The portable device according to claim 1 wherein the request means for entering a selection of roadways and directions of travel includes pressure-sensing means associated with map means affixed thereto, such that application of pressure to the map means by said finger causes electrical signals related to the location of the pressure to be generated and put out.

3. The portable device according to claim 1 wherein the presentation means includes means for synthesizing audio voice sounds and loudspeaking means for reproducing synthesized voice sounds and wherein the presentation report is presented to the user aurally via said loudspeaking means.

4. The portable device according to claim 1 wherein the presentation means comprises aural presentation means for aurally presenting the presentation report.

5. A method for presenting traffic condition information to a user via a portable, battery operated receiving and data processing device adapted to be held and operated by one hand of the user, comprising the steps of:

a) receiving with the aid of the device digitally coded ratio signals representing broadcast traffic condition information relating to traffic conditions of a predetermined geographic area;

b) recognizing encoded traffic reports within the received digitally coded radio signals with digital recognition circuitry within the device;

c) storing within a digital memory of the device a plurality of the recognized encoded traffic reports;

d) receiving with the aid of an input means of the device operated by said one hand user supplied travel selected information including selection of roadways and directions of travel and storing the travel selection information in the digital memory;

e) searching the encoded traffic reports stored within the digital memory with a searching means of the device in relation to the selected roadways and directions of travel stored in the digital memory, thereby to locate portions of said traffic reports pertinent to said travel selection information;

f) calculating with programmed digital processing means within the device travel routing information based upon said located portions of said encoded traffic reports and said travel selection information; and, g) presenting via presentation means of the device the calculated travel routing information.

6. The method set forth in claim 5 wherein the step of storing recognized encoded traffic reports comprises the step of replacing previously stored encoded traffic reports with currently received recognized encoded traffic reports.

7. The method set forth in claim 5 wherein the step of presenting the calculated travel routing information is carried out in response to a further step of responding to a user request entered via user data entry means at the device for presentation of the calculated travel routing information.

8. The method set forth in claim 7 wherein the steps of searching the encoded traffic reports and calculating travel routing information are carried out in response to the step of responding to a user request for presentation of the calculated travel routing information.

9. The method set forth in claim 5 wherein the step of presenting the calculated travel routing information comprises the steps of converting the calculated travel routing information into analog sound signals and translating the analog sound signals into audible sounds with a loudspeaking means of the receiving device.

10. A self-contained, portable device adapted to be held in, and operated by, a user's one hand for presenting information on the state of traffic conditions in a predefined geographical area, comprising:

a) radio receiver means for deriving digitally coded radio signals from a transmitting source within the geographical area;

b) derivation means connected to the radio receiver means for deriving a stream of data signals from the coded radio signals;

c) recognition means connected to receive the stream of data signals to recognize those data signals which constitute encoded traffic reports which are to e received by the device;

d) storage means connected t the recognition means for storing a plurality of encoded traffic reports in a memory of sufficient size to hold a predetermined number of currently active traffic reports for the geographical area;

e) pressure-sensitive data entry means overlaid with map means generally depicting the geographical area, said data entry means being operable by a finger of the user's one hand for entering a selection of roadways and directions of travel into the storage means for which presentation of traffic reports are desired;

f) control switch means operable by the finger of the user's one hand for entering user defined selection criteria requesting presentation of selected traffic reports based upon selected roadway and direction of travel;

g) search means for searching the traffic reports stored in the storage means and selecting means for selecting stored traffic reports which are coded to be in accordance with the user defined selection criteria;

h) conversion means for converting each selected encoded traffic report into a presentation report; and, i) presentation means including loudspeaking means for aurally presenting the presentation report to the user.

* * * * *